US007114479B1

(12) United States Patent
Lee

(10) Patent No.: US 7,114,479 B1
(45) Date of Patent: Oct. 3, 2006

(54) CABLE-PULL TYPE ENGINE STARTING DEVICE

(76) Inventor: Hsin-Chih Chung Lee, No. 21-8, Shang San Cho Woo, Wuchang-Li, Chungli City, Tao Yuan Hsien (TW)

( * ) Notice: Subject to any disclaimer, the term of this patent is extended or adjusted under 35 U.S.C. 154(b) by 0 days.

(21) Appl. No.: 11/227,552

(22) Filed: Sep. 16, 2005

(51) Int. Cl.
*F02N 3/02* (2006.01)

(52) U.S. Cl. ..... 123/185.3

(58) Field of Classification Search .. 123/185.2–185.4, 123/185.14
See application file for complete search history.

(56) References Cited

U.S. PATENT DOCUMENTS 6,679,217 B1 * 1/2004 Nieda et al. ..... 123/185.14
2002/0174848 A1 11/2002 Nieda et al.
2004/0065289 A1 4/2004 Leasure et al.

* cited by examiner

*Primary Examiner*—Andrew M. Dolinar
(74) *Attorney, Agent, or Firm*—Rabin & Berdo, P.C.

(57) ABSTRACT

An engine starting device includes a starting unit, a clutch unit and a transmission unit, all of the three units being installed on the same axle. The starting unit and the clutch unit are connected with each other by friction therebetween and the friction is applied only when the starting unit is operated in desired direction so that the starting unit and the clutch unit are co-rotated. The clutch unit is connected to the transmission unit so that the power can be directly transferred to the transmission unit. The device employs the pressure of the engine to compress the coil spring which generates a force to accelerate the speed of the engine such that the user can easily start the engine.

5 Claims, 4 Drawing Sheets

CABLE-PULL TYPE ENGINE STARTING DEVICE

BACKGROUND OF THE INVENTION

1. Field of the Invention

The present invention relates to a cable-pull type engine starting device having a clutch unit so as to save users' effort to start the engine.

2. The Prior Arts

A conventional power tool with engine includes a starting device for starting the engine to output power from the engine. For example, an internal combustion engine includes a starting device that includes a handle, a case, a spring unit and a cable wheel wherein a cable is connected to the handle and wrapped the cable wheel which is connected to the spring unit so that when the users pull the handle, the cable rotates the cable wheel to activate the engine. The cable wheel is then rotated backward due to the spring unit to its original position when the handle is released. However, there are two obvious shortcomings, one of which is that the wheel unit is difficult to be rotated by the pulling force of the user. This is because the cable wheel is connected to the spring unit and the user has to overcome the pressure in the engine to let the cable wheel to rotate the spring unit. In other words, the longer the cable has to be pulled, the harder the user can successfully activate the engine. The other shortcoming is that the conventional starting device activates the engine very slow and may require more than one time of pulling. This is because of the high pressure in the engine so that the user has to apply a tremendous force to rotate the spring unit. This means the user has to pull several times and increase the pull speed to start the engine.

The present invention intends to provide an efficient starting device that allows the user to easily start the engine without too much effort.

SUMMARY OF THE INVENTION

The present invention relates to an engine starting device for power tools and the device comprises a starting unit which includes a handle connected to a cable which is wrapped around a cable wheel received in a case. A first coil spring with a spring cover mounted thereto is received in the case and a driving ring is securely connected to the cable wheel. A clutch unit has a first ring, a rotator having a plurality of notches defined in an inner periphery thereof and a second ring. Each notch is a trapezoid notch and includes a shallow end and a deep end in radial direction of the rotator. Each notch further has a roller and a spring received therein which biases the roller to be engaged with the shallow end and protruding out from the rotator. The first ring, the rotator and the second ring are connected with each other. The driving ring is located in a center of the rotator and the rollers are in contact with an outer periphery of the driving ring. A transmission unit has a second coil spring engaged with a spring wheel connected thereto and a ratchet wheel. The second coil spring is connected to the spring wheel and the ratchet wheel. The spring wheel is secured to the rotator.

The starting unit and the clutch unit are connected with each other by friction therebetween and the friction is applied only when the starting unit is operated in desired direction. The clutch unit is connected to the transmission unit so that the power can be directly transferred to the transmission unit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
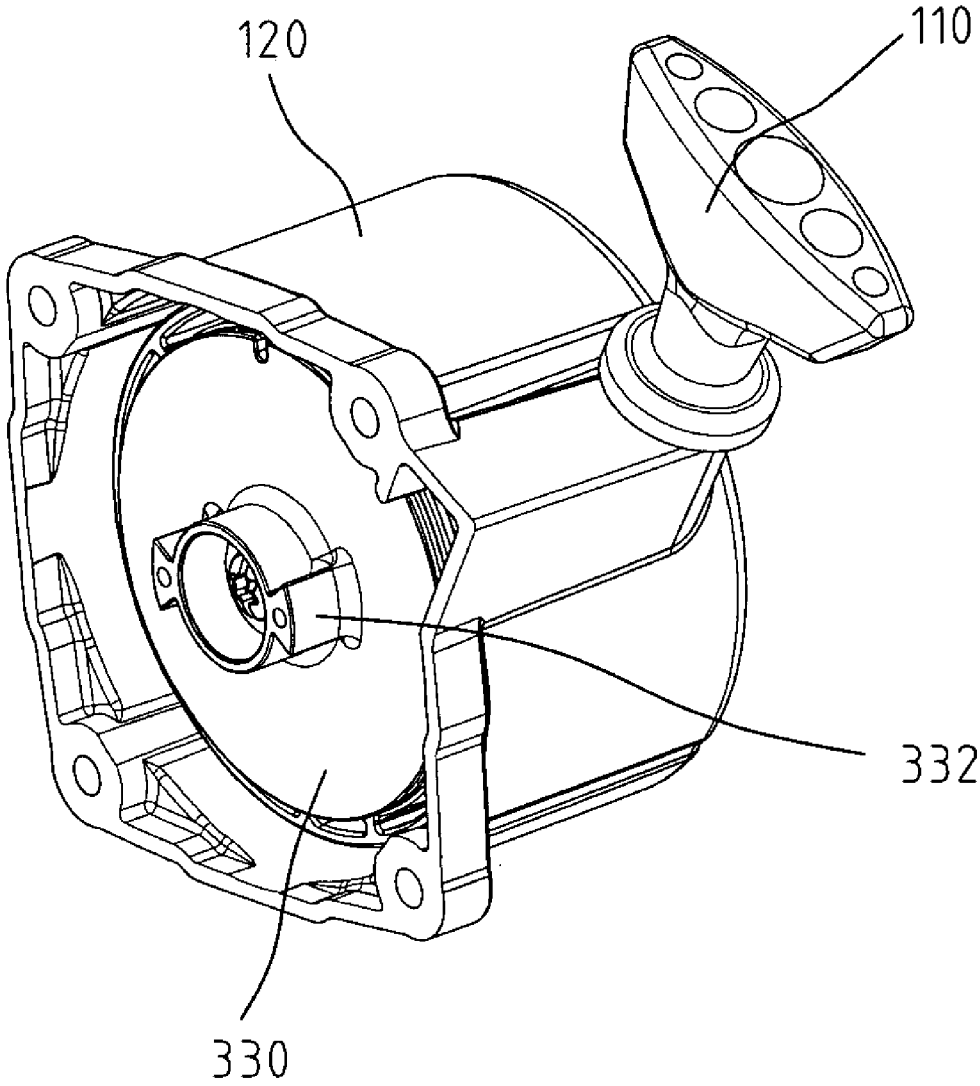
FIG. 1 is a perspective view showing an engine starting device in accordance with the present invention.
Figure 2:
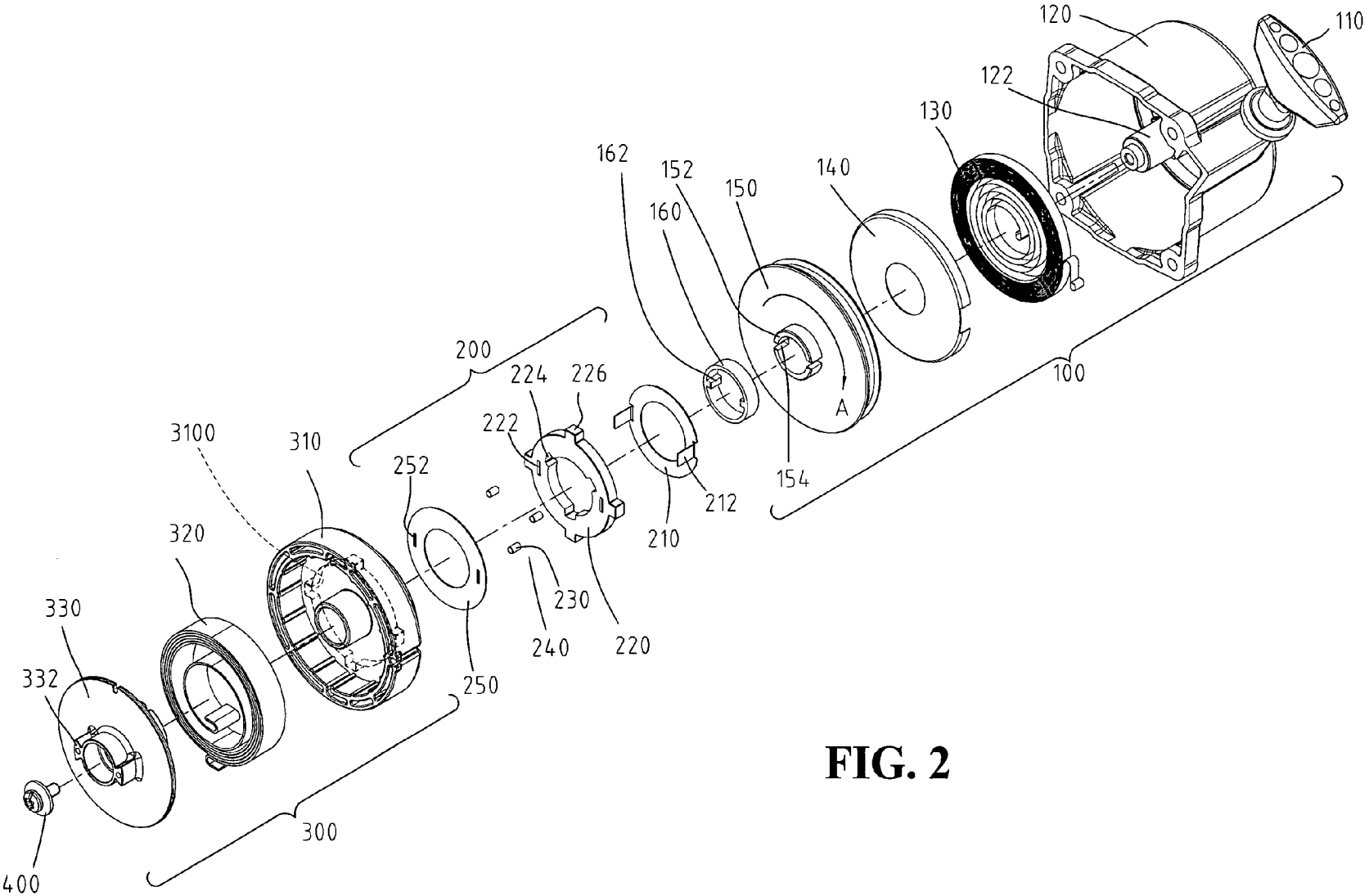
FIG. 2 is an exploded view showing the engine starting device of the present invention.
Figure 3:
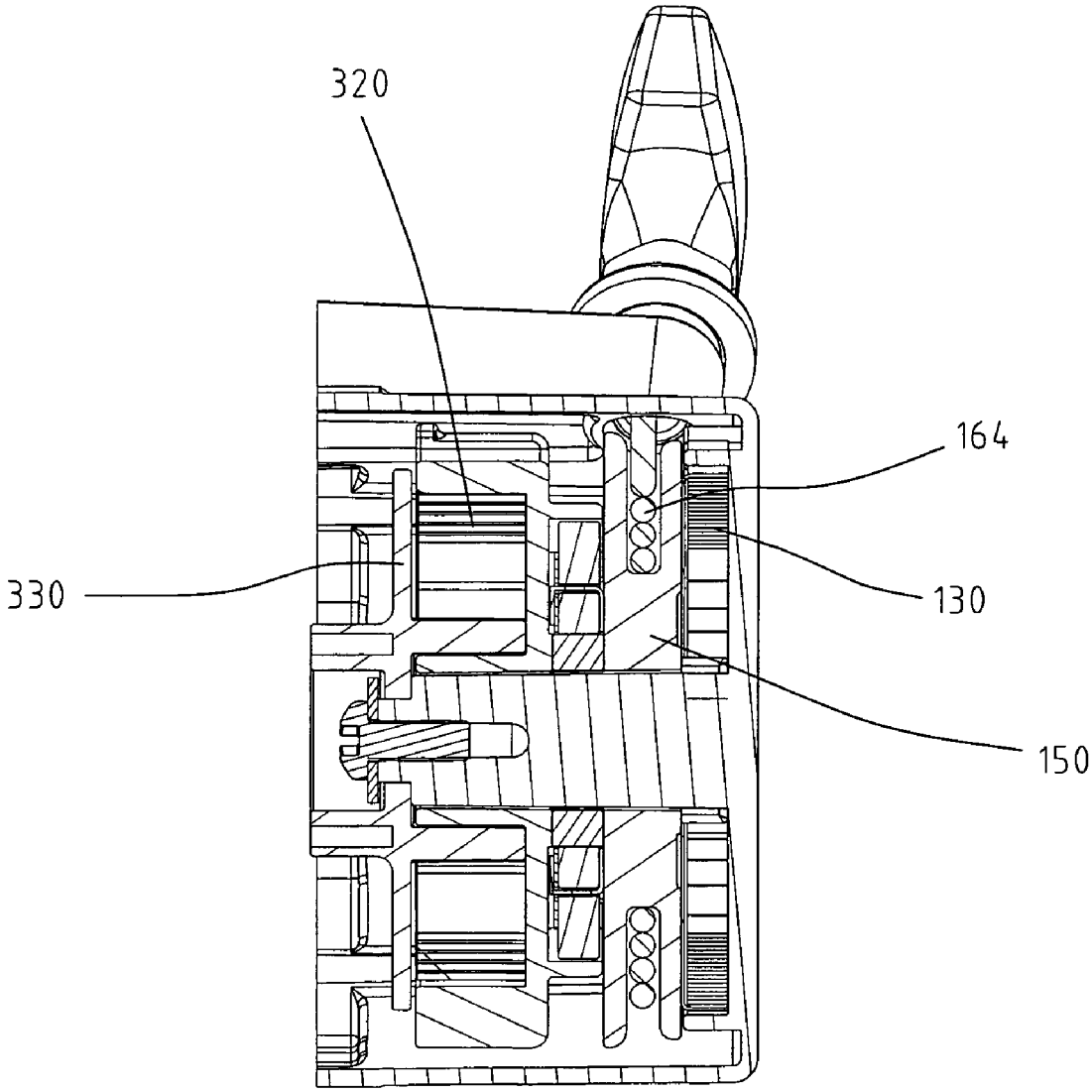
FIG. 3 is a cross sectional view of the engine starting device of the present invention.
Figure 4:
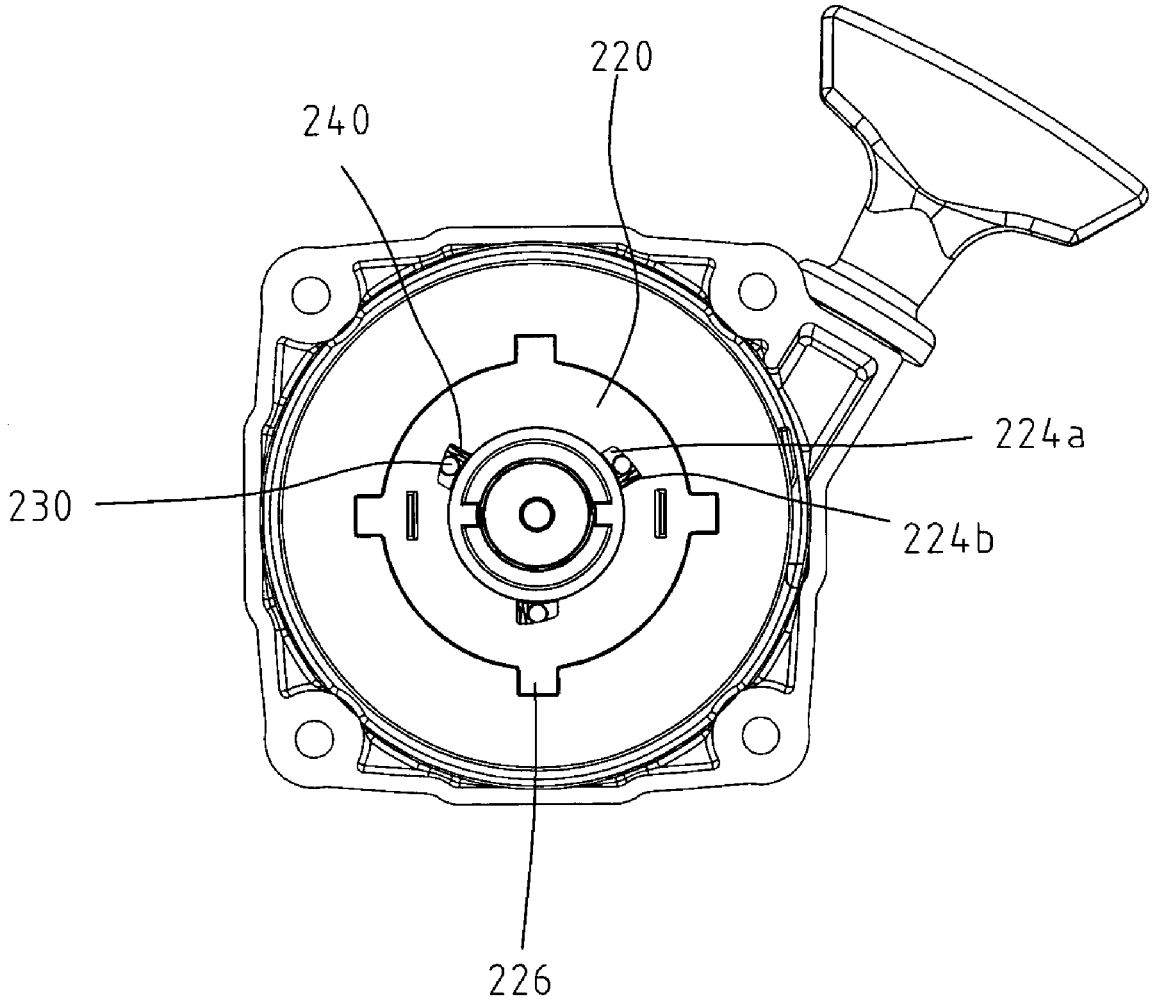
FIG. 4 is a side view showing positions of rollers in notches in a rotator of the present invention.

Referring to FIGS. 1–4, an engine starting device for power tools in accordance with the present invention comprises a starting unit 100, a clutch unit 200 and a transmission unit 300. The starting unit 100 includes a handle 110 removably connected to a case 120 in which a first coil spring 130 and a cable wheel 150 are received. A spring cover 140 is mounted to the first coil spring 130 and a cable 164 is wrapped around the cable wheel 150 and connected to the handle 110, so that when pulling the handle 110, the cable wheel 150 is rotated. The cable wheel 150 has a neck 152 extending from a side thereof and the neck 152 has a plurality of engaging recesses 154. A driving ring 160 has a plurality of protrusions 162 which are engaged with the engaging recesses 154.

The clutch unit 200 includes a first ring 210, a rotator 220 having a plurality of notches 224 defined in an inner periphery thereof and a second ring 250. Each notch 224 is a trapezoid notch and includes a shallow end 224*a* and a deep end 224*b* in radial direction of the rotator 220. Each notch 224 further has a roller 230 and a spring 240 received therein which biases the roller 230 to be engaged with the shallow end 224*a* and protruding out from the rotator 220. The first ring 210 has two insertions 212 which extend perpendicularly from a side of the first ring 210, and the rotator 220 and the second ring 250 each has two slits 222, 252 so that the two insertions 212 extend through the slits 222, 252. The driving ring 160 is located in a center of the rotator 220 and the rollers 230 are in contact with an outer periphery of the driving ring 160.

The arrangement of the shallow end 224*a* and deep end 224*b* meets the requirement as described hereinafter. When the cable wheel 150 is rotated clockwise as indicated by arrow "A" in FIG. 2, the rollers 230 are moved toward the shallow ends 224*a* due to initial forces and the springs 240. The rollers 230 then contact against the driving ring 160 so that the friction is able to let the clutch unit 200 co-rotate with the starting unit 100. When the cable wheel 150 is rotated counter clockwise, the rollers 230 are moved toward the deep ends 224*b* so that the rollers 230 can be spin independently so that the friction cannot make the clutch unit 200 co-rotate with the starting unit 100.

The transmission unit 300 has a second coil spring 320 engaged with a spring wheel 310 and a ratchet wheel 330. The second coil spring 320 is connected to the spring wheel 310 and the ratchet wheel 330. The rotator 220 includes a plurality of engaging protrusions 226 extending radially from an outer periphery thereof and the spring wheel 310 includes a plurality of receiving recesses 3100 which receive the engaging protrusions 226. The clutch unit 200 and the transmission unit 300 are installed on the same axle 122 extending from the case 120, and a screw 400 is connected to a distal end of the axle 122 to position the starting unit 100, the clutch unit 200 and the transmission unit 300.

When the user pulls the handle 110, the cable 164 drives the cable wheel 150 to rotate counter clockwise and the first coil spring 130 is deformed. The clutch unit 200 is co-rotated with the cable wheel 150 so that the power is transferred to the engine (not shown) via driving protrusions 332 on the ratchet wheel 330.

When the user stops the pulling action, the cable wheel 150 does not rotate counter clockwise further, so that the clutch unit 200 is rotated clockwise due to initial force and the transmission unit 300 is co-rotated with the clutch unit 200.

The second coil spring 320 is compressed by the pressure in the engine till the revolutions of the transmission unit 300 increases and compresses the second coil spring 320. The spring wheel 310 and the clutch unit 200 then stop to rotate clockwise and start to rotate counter clockwise. Therefore, the rollers 230 do not apply positive force to the first ring 210, so that the friction between the cable wheel 150 and the clutch unit 200 cannot rotate the cable wheel 150. When the force of the second coil spring 320 gradually reduced, the rotation speed of the rotator 220 is also reduced. Therefore, the rollers 230 are biased by the springs 240 to the shallow ends 224*a* and the friction is then increased to rotate the cable wheel 150 to rotate clockwise slightly. The remained force of the second coil spring 320 can overcome the force of the first coil spring 130, such that the first coil spring 130 does not apply too much resistance to the user who feels the starting device is easily to operate.

By the clutch unit 200, the torque of the cable wheel 150 can be transferred to the ratchet wheel 330 so that the handle 110, the cable 164 and the cable wheel 150 are applied by the force of the first coil spring 130 to rotate clockwise to their original positions. The positive friction force between the clutch unit 200 and the cable wheel 150 generates only when the cable wheel 150 is rotated by the pulling of the cable 164, so that the clutch unit 200 does not affected by the cable wheel 150 which transfers the torque generated when the cable wheel 150 rotates counter clockwise to the transmission unit 300.

While we have shown and described the embodiment in accordance with the present invention, it should be clear to those skilled in the art that further embodiments may be made without departing from the scope of the present invention.

What is claimed is:

1. An engine starting device comprising:

a starting unit including a handle removably connected to a case, a first coil spring and a cable wheel received in the case, a spring cover mounted to the first coil spring and a driving ring securely connected to the cable wheel, a cable wrapped around the cable wheel and connected to the handle;

a clutch unit having a first ring, a rotator having a plurality of notches defined in an inner periphery thereof and a second ring, each notch being a trapezoid notch and having a shallow end and a deep end in radial direction of the rotator, each notch having a roller and a spring received therein which biases the roller to be engaged with the shallow end and protruding out from the rotator, the first ring, the rotator and the second ring being connected with each other, the driving ring located in a center of the rotator and the rollers being in contact with an outer periphery of the driving ring; and a transmission unit having a second coil spring engaged with a spring wheel and a ratchet wheel, the second coil spring connected to the spring wheel and the ratchet wheel, the spring wheel secured to the rotator.

2. The device as claimed in claim 1, wherein the cable wheel has a neck and a plurality of engaging recesses, the driving ring has a plurality of protrusions which are engaged with the engaging recesses.

3. The device as claimed in claim 1, wherein the first ring has two insertions which extend perpendicularly from a side of the first ring, the rotator and the second ring each has two slits so that the two insertions extend through the slits.

4. The device as claimed in claim 1, wherein the rotator includes a plurality of engaging protrusions extending radially from an outer periphery thereof, the spring wheel includes a plurality of receiving recesses which receive the engaging protrusions.

5. The device as claimed in claim 1, wherein the starting unit, the clutch unit and the transmission unit are installed on the same axle.

* * * * *